US012449226B2

(12) United States Patent
O'Loughlin et al.

(10) Patent No.: US 12,449,226 B2
(45) Date of Patent: Oct. 21, 2025

(54) ARCHERY STABILIZER MOUNT AND RELATED METHOD OF USE

(71) Applicant: O'Loughlin Financial, LLC, Orono, MN (US)

(72) Inventors: Rory O'Loughlin, Orono, MN (US); Matthew Haas, Duluth, MN (US)

(73) Assignee: O'Loughlin Financial, LLC, Orono, MN (US)

( * ) Notice: Subject to any disclaimer, the term of this patent is extended or adjusted under 35 U.S.C. 154(b) by 371 days.

(21) Appl. No.: 18/118,203

(22) Filed: Mar. 7, 2023

(65) Prior Publication Data

US 2024/0302126 A1 Sep. 12, 2024

(51) Int. Cl.
*F41B 5/14* (2006.01)
*F41B 5/20* (2006.01)

(52) U.S. Cl.
CPC ..... *F41B 5/1426* (2013.01); *F41B 5/1403* (2013.01); *F41B 5/1442* (2013.01)

(58) Field of Classification Search
CPC .... F41B 5/1426; F41B 5/1403; F41B 5/1442; F41G 1/467
USPC ..... 124/86, 87, 88, 89
See application file for complete search history.

(56) References Cited

U.S. PATENT DOCUMENTS 8,522,766 B2 * 9/2013 LoRocco ..... F16B 5/00 124/25.7
8,701,645 B2 4/2014 Stokes
8,806,796 B1 * 8/2014 Clifton ..... F41G 11/003 42/127
9,086,250 B2 7/2015 Stokes
10,948,258 B1 * 3/2021 Kitts ..... F41B 5/1403
11,353,280 B1 * 6/2022 Keeney ..... F41B 5/1426
11,428,497 B1 * 8/2022 Keeney ..... F16F 15/03
2013/0055998 A1 * 3/2013 LoRocco ..... F41B 5/1426 29/428
2013/0081604 A1 * 4/2013 Lee ..... F41B 5/066 29/428
2013/0288743 A1 * 10/2013 Hunt ..... F16M 11/2014 29/434
2015/0204632 A1 * 7/2015 Green ..... F41G 1/467 124/44.5
2023/0221090 A1 * 7/2023 Summers ..... F41B 5/14 124/86
2024/0159490 A1 * 5/2024 McPherson ..... F41B 5/1426

* cited by examiner

*Primary Examiner* — John E Simms, Jr.

(74) *Attorney, Agent, or Firm* — Warner Norcross + Judd LLP

(57) ABSTRACT

An archery stabilizer mount is provided and can include a base that indexes an archery stabilizer in a fixed, angular orientation relative to the base, and a bracket, which attaches to an archery bow riser, where the base is selectively installable and removable from the bracket without altering the stabilizer orientation relative to the base and/or the archery bow. The base can be repeatedly removed from and installed relative to the bracket while maintaining a reference element of the archery stabilizer indexed in the fixed angular orientation relative to the base and to the bracket. The reference element can be a branding element, such as a logo, image, alphanumeric characters or other indicia.

18 Claims, 5 Drawing Sheets

ARCHERY STABILIZER MOUNT AND RELATED METHOD OF USE

BACKGROUND OF THE INVENTION

The present invention relates to archery, and more particularly to a mount for mounting an archery stabilizer to an archery bow.

Many archers add stabilizers to their archery bows to counter pitch, roll or yaw movement of the bow, to add forward weight to the bow, and/or to attenuate vibration in the archery bow upon shooting the bow. Generally, these stabilizers are weighted and project forwardly from a riser of the bow. Many archery stabilizers are in the form of a cylindrical weighted rod that projects forwardly several inches from the riser. The rod typically includes a rearwardly projecting, threaded stud that screws into a corresponding threaded hole in the riser. The construction of stabilizers varies, depending on the application. For example, stabilizers used on hunting bows are generally small and compact to enable a bow hunter to adequately maneuver the archery bow in a hunting situation. Stabilizers used for competitive shooting, where there are not space constraints, tend to be rather large.

Regardless of the construction, archery stabilizers typically increase the overall dimensions of an archery bow from front to rear when attached to the bow. Accordingly, many archers will remove the archery stabilizer from the bow when transporting the bow, particularly when transporting the bow in a compact bow case that does not have space to accommodate the stabilizer. After transport, the archer will reattach the stabilizer to the bow. An issue arises in such reattachment, particularly where the stabilizer includes a logo on the side of the stabilizer. The archer usually will desire the logo to align perfectly and neatly along the stabilizer, so that is easily readable. However, because the stabilizer is screwed with its stud into the riser, this alignment typically requires trial and error installation of the stabilizer to properly align the logo. Sometimes, archers will use one or more spacer washers to index the logo to a particular point when screwing the stud into the riser. These washers, however, can become lost in transport. Further, over time parts can wear, and logo alignment can change due to the stabilizer being rotated too far or too little when being attached to the bow riser.

Accordingly, there remains room for improvement in the field of attaching archery stabilizers to archery bows, and particularly when attempting to consistently index the stabilizer relative to the riser.

SUMMARY OF THE INVENTION

An archery stabilizer mount is provided and can include a base that indexes an archery stabilizer in a fixed, angular orientation relative to the base, and a bracket, which attaches to an archery bow riser, where the base is selectively installable and removable from the bracket without altering the stabilizer orientation relative to the base and/or the archery bow.

In one embodiment, the archery stabilizer can include a reference element aligned with and/or oriented relative to a longitudinal axis of the elongated archery stabilizer. The reference element can be a branding element having a branding axis.

In another embodiment, the branding element optionally can be more visible or easily read or perceived when the branding axis lays in an aesthetic plane, for example, a horizontal plane. The base can register with the bracket to index the archery stabilizer perfectly in the fixed, angular orientation so that the branding element lays in the aesthetic plane.

In still another embodiment, the branding element can include one or more alphanumeric characters extending along the branding axis. These characters can comprise a brand, a logo, a message or other information.

In yet another embodiment, the mount can include a lock operable in a lock mode to secure the base relative to the bracket, and in an unlocked mode to enable the base to be removed from the bracket, along with the archery stabilizer. The lock can be transitioned from the locked to unlocked modes, so the base can be repeatedly installed relative to and removed from the bracket while maintaining the reference element in the fixed angular orientation relative to the base and to the bracket. In turn, after an initial calibration, this can ensure that the branding element is aligned with the aesthetic plane each and every time the archery stabilizer and base are joined with the bracket to mount the stabilizer to the archery bow.

In even another embodiment, the bracket can include a first bracket rail and a second bracket rail, and can define a bracket fastener hole. A bracket fastener can project though the bracket fastener hole and can secure the bracket to an archery bow riser.

In a further embodiment, the base can include a first base rail and a second base rail. The base can define a stabilizer fastener hole having a stabilizer fastener hole axis aligned with the bracket fastener hole axis.

In still a further embodiment, the mount and bracket can be structured so that when the base is installed relative to the bracket, the first base rail interfaces with the first bracket rail and the second base rail interfaced with the second bracket rail.

In yet a further embodiment, the stabilizer fastener hole axis can be parallel to the bracket fastener hole axis when the base is installed relative to the bracket. The bracket fastener and bracket fastener hole can be covered by the base when the base is installed relative to the bracket.

In even a further embodiment, the lock can include a lever joined with a lock fastener of the lock, and a cam. The cam can be moveable relative to and/or can engage at least one of the base rails and/or the mount rails to urge the rails into engagement with one another. In turn, this can clamp the base relative to the mount and secure the mount in a fixed position relative to the riser.

In another embodiment, the lock can include a secondary fastener disposed transverse to a lock fastener. The secondary fastener can engage the lock fastener to secure the lock fastener in a fixed position. Optionally, the secondary fastener can be a set screw, and can be secured against the lock fastener after the lock is calibrated to apply a clamping force. The lock can thereby operate in to apply a consistent clamping force due to the lock fastener being in the fixed position.

In still another embodiment, a method is provided. The method can include securing a base to a riser of an archery bow with a fastener projecting in a riser hole defined by the riser, the base including a first base rail and an opposing second base rail; providing an elongated archery stabilizer including a reference element aligned with a longitudinal axis of the elongated archery stabilizer; indexing the reference element in a preselected angular orientation relative to a mount including a first mount rail and an opposing second mount rail; securing the elongated archery stabilizer to the mount in a fixed manner, with the reference element being fixed in the preselected angular orientation relative to the mount; interfacing the first base rail with the first mount rail, and the second base rail with the second mount rail so that the mount registers with the base; and operating a lock to secure the mount in a fixed position relative to the base and the riser.

The reference element can remain in the preselected angular orientation relative to the mount and thus the riser during a subsequent removal and re-installation of the elongated archery stabilizer relative to the riser by aligning the first and second mount rails with the first and second base rails.

In yet another embodiment, the method can include covering the fastener with the mount as the mount registers with the base.

In even another embodiment, the method can include tightening a retaining element, for example a nut, disposed between the bracket and the base, to engage the elongated archery stabilizer to index and secure the reference element of the archery stabilizer in the fixed angular orientation relative to the base. The retaining element can be located between all the rails when the base is installed relative to the bracket.

In a further embodiment, the method can include moving a lever joined with a lock fastener of the lock; and engaging a cam against at least one of the first and second base rails to urge the at least one of the first and second mount rails into engagement with the mount. The first and second mount rails can engage the first and second base rails, respectively, to clamp the base relative to the mount and secure the mount in a fixed position relative to the riser.

The current embodiments provide an archery stabilizer mount and related method that consistently and accurately mount an archery bow stabilizer relative to an archery bow. In so doing, the base can be repeatedly installed relative to the bracket while maintaining a reference element, for example a branding element, in the fixed angular orientation relative to the base and to the bracket, and thus the riser. This can provide consistent positioning and orientation of the reference element to facilitate viewing and/or perception of the same. An archer can thus confidently install, remove and reinstall the archery stabilizer using the current mount, knowing that the reference element will be consistently aligned to the archer's preferences each and every time. Therefore the user need not be consumed with trial and error positioning of the stabilizer and alignment of the reference element every time the archer removes and reinstalls the stabilizer. This can save significant time and effort in preparing the archery bow for use with the stabilizer.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
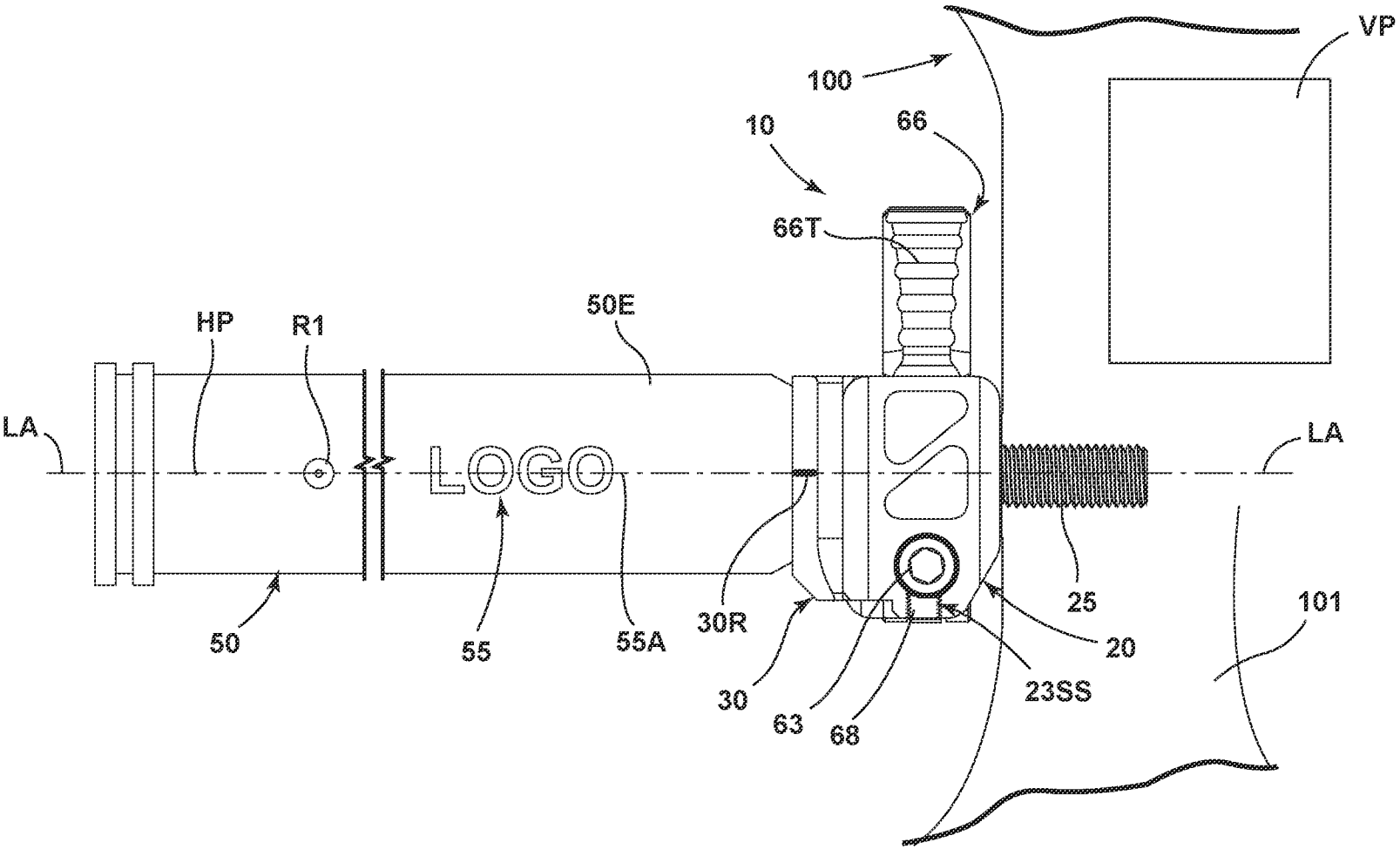
FIG. 1 is a side view of an archery stabilizer mount of a current embodiment mounted on a riser of a bow and aligning a reference element of the archery stabilizer consistently with the mount and thus the riser.

A current embodiment of the archery stabilizer mount is shown in FIGS. 1-5 and generally designated 10. The mount 10 can include a bracket 20 configured to be joined with a riser 101 of an archery bow 100 via a bracket fastener 25 as shown in FIG. 1. The archery bow can be a compound bow, recurve bow, long bow, crossbow and/or hybrids of the foregoing. The mount 10 can include a base 30 that interfaces with the bracket 20, and a lock 60 that secures the base and mount relative to one another in a secured, fixed position and thus fixing the base 20 rigidly to the riser 101 of the bow 100. The base 30 can be fixedly secured to an archery bow stabilizer 50, optionally via a stud 53 projecting through a stabilizer fastener hole 30H and being further secured to a retaining element 37 which optionally can be in the form of a nut 37. The nut 37 optionally can be threaded onto a threaded shaft 53S of the stud 53 of the archery bow stabilizer 50.

Figure 2:
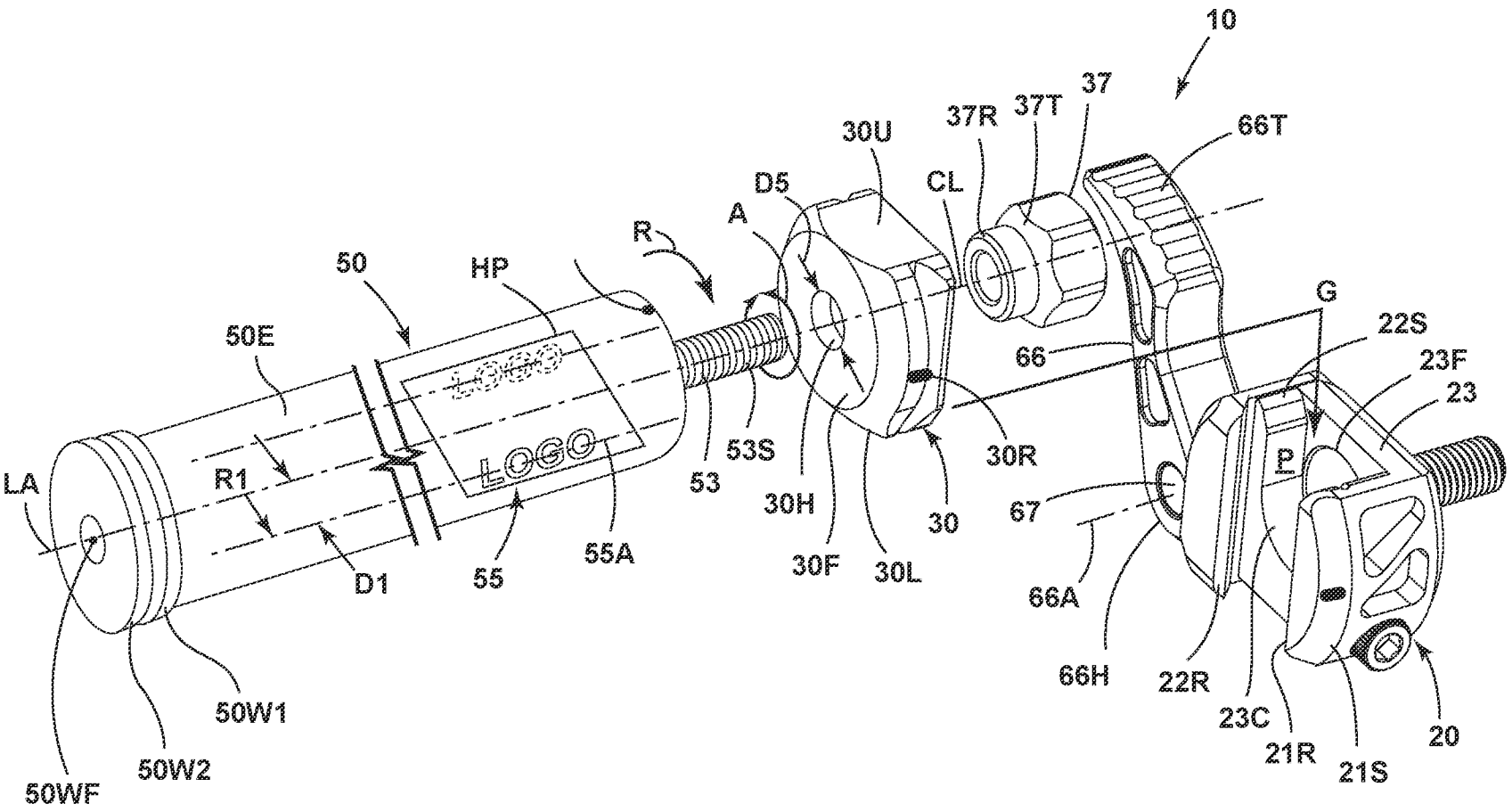
FIG. 2 is an exploded view of the archery stabilizer being secured to a base with a fastener to align the reference element at a preselected angular orientation relative to the base, before the base is installed relative to a bracket of the mount.

As shown in FIGS. 1 and 2, the archery bow stabilizer 50 can include a reference element 55 which optionally can be in the form of a branding element and aligned along a branding element axis 55A. The reference element or branding element can be in the form of a logo, image, pattern, information, alphanumeric characters, aesthetic characters, photograph, camouflage, stripes, lines, shapes and/or other indicia. Where the element is in the form of a logo, such as a brand of the archery stabilizer, and archery bow, or some other brand, and aligned along a branding axis 55A, sometimes referred to herein as a reference axis, that logo can be more visible, more easy to read, more aesthetically pleasing, or generally more easy to perceive when the branding axis and/or reference element 55, or the stabilizer 50 itself, is indexed in a fixed angular orientation relative to the base 30. Optionally, in one exemplary fixed, angular orientation, the axis 55A can be aligned and fixed in position relative to a reference line 30R that can be parallel with a longitudinal axis LA of the base fastener hole 30H. Further optionally, this reference line 30R can be located midway, or exactly halfway, between the upper surface 30U and lower surface 30L of the base 30. This reference line 30R also can be located along a bisecting line that bisects the fastener hole 30H into equal upper and lower segments. Although shown as being present on the exterior of the base 30, the reference line 30R can be a theoretical line that is not demarcated on the base or other components of the mount 10 in some applications.

As mentioned above, the stabilizer 50 can be disposed in a preselected angular orientation. Optionally, this preselected angular orientation of the stabilizer can correspond to the reference element 55 coinciding with the branding axis 55A and the longitudinal axis LA of the archery stabilizer 50 and/or the fastener hole 38 laying in a horizontal plane HP when the archery bow is held or drawn by a user and the riser 101 extends upright in a vertical plane VP as shown in FIG. 1. In this preselected angular orientation, the reference element 55, and more particularly the access 55A thereof can further optionally align with the reference line 30R, which again may be an actual line or a theoretical line. Of course, depending on the reference element, and its orientation relative to the exterior 50E of the archery stabilizer, the preselected angular orientation may alternatively coincide with the branding axis 50A being offset, transverse to, or at some angle relative to the base 30 and/or the horizontal plane HP. In many applications however, that preselected angular orientation can result in the reference element 55, when in the form of a logo having alphanumeric characters, such as letters, numbers or other symbols, being generally disposed parallel to the longitudinal axis LA and aligned with a horizontal plane HP passing through the longitudinal axis LA when the riser is in a vertical plane VP.

Figure 3:
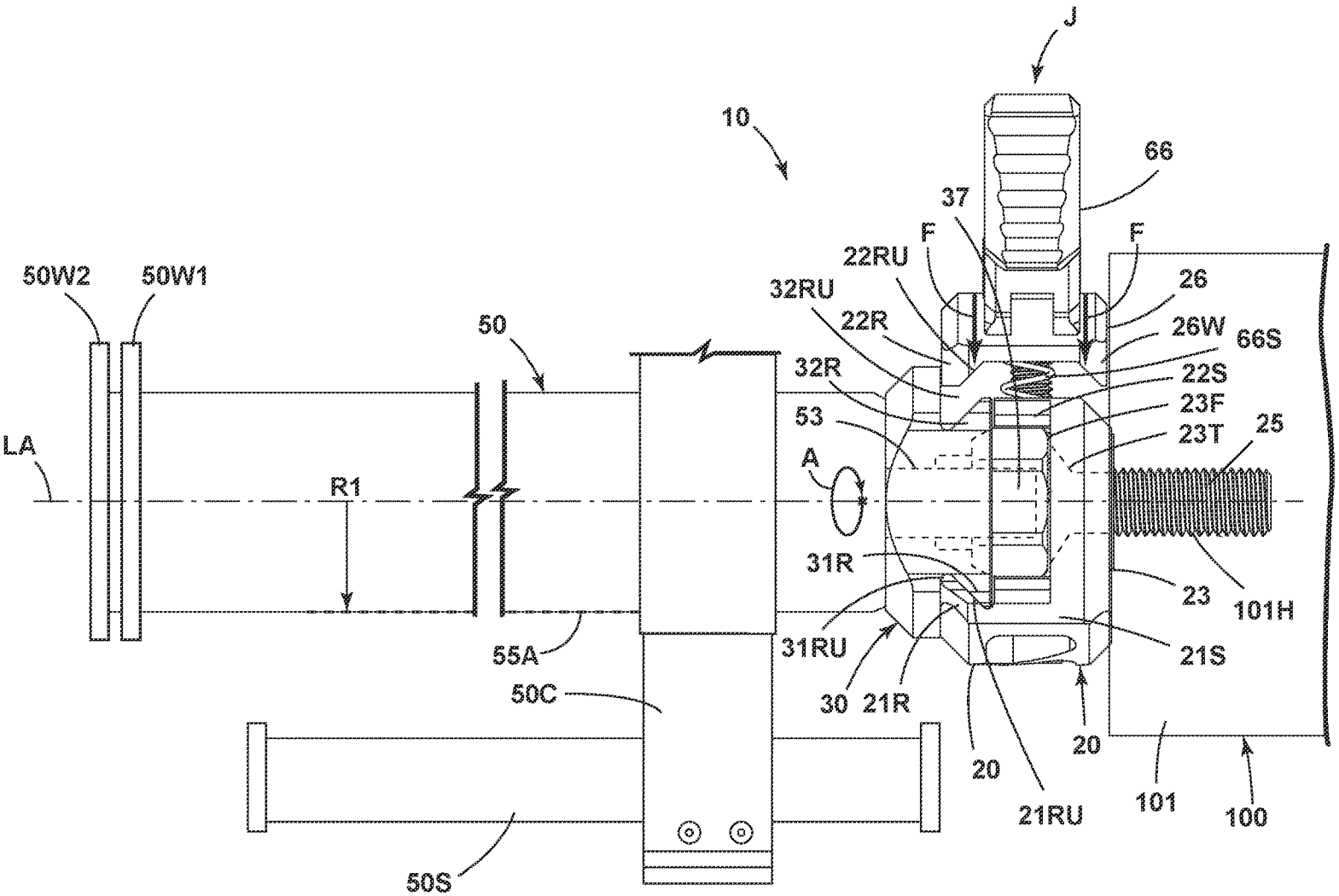
FIG. 3 is a top view of the mount transitioning from an unlocked mode to a locked mode to secure the base to the bracket of the archery stabilizer mount.

The archery stabilizer 50 can be secured to the base 30 in a preselected angular orientation as well. For example, with reference to FIG. 2, the archery stabilizer 50 can be moved in a close proximity relative to the base 30 and in particular its forward surface 30F. The exterior 50E of the stabilizer 50, which optionally can be a cylindrical shape, can be rotated in directions R about the longitudinal axis LA of the stabilizer and/or the base hole 30H and its axis until the stabilizer 50, or some point PT on its exterior 50E is at some preselected angle about those axes relative to the base 30. As shown in FIG. 1, that angle coincide with the point PT being vertically above the longitudinal axis LA and/or the corresponding axis of the hole 30H. This further can correspond to the reference element 55 as described above being aligned with some reference line 30R, or some structure, projection, or additional stabilizer bars extending from the archery stabilizer 50 being disposed at some angle A about the longitudinal axis LA. For example, as shown in FIG. 3, the user can attach a secondary stabilizer 50S via a clamp 50C to the archery stabilizer 50. The user may desire to index that secondary stabilizer 50S at some preselected angle A about the longitudinal axis LA.

The component of the mount 10 will now be described in further detail with reference to FIGS. 1-5. Starting with the bracket 20, that bracket can include a plate 23 that defines a bracket fastener hole 20H having a bracket fastener axis BFA, which generally can align with a shaft axis SA of the bracket fastener 25 as well as longitudinal axis LA of the archery stabilizer 50 when the stabilizer is joined with the mount 10. The plate 23 can be configured to be mounted against the riser when the bracket fastener 25 is installed in a riser hole 101H as shown in FIG. 3 and the mount 10 generally is installed relative to the bow 100. The plate 23 can project forwardly and can include a first side wall 21S that extends outward and is joined with a first bracket rail 21R. This first bracket rail 21R can include an undercut 21RU that can accept or receive a first rail 31R of the base 30 described further below. The bracket 20 can include a second side wall 22S that opposes the first side wall 21S. The second side wall 22S however can be void of a bracket rail that is attached directly to that second side wall 22S.

The first side wall 21S and second side wall 22S can be separated and can form a pocket P therebetween. The pocket P can be bounded as well by the forward surface 23F of the plate 23 of the bracket. That forward surface 23F optionally can define a tapered recess 23T that can receive the head 25H of the bracket fastener 25. Of course, the recess and head can have different shapes, but otherwise the recess can be configured to receive the head so that the outer surface of the head is flush with the forward surface 23F of the plate 23. In this manner, the retaining element 37 associated with the mount 30 can easily fit within the pocket P of the base 20. Optionally, the pocket P can be bounded by a curved cup shape wall 23C that transitions to the respective sidewalls 21S and 22S. This cup wall 23C can form a stop that engages the retaining element when the retaining element is moved in the pocket P and the base rails slide or move within the respective undercuts or relative to the bracket rails.

Figure 4:
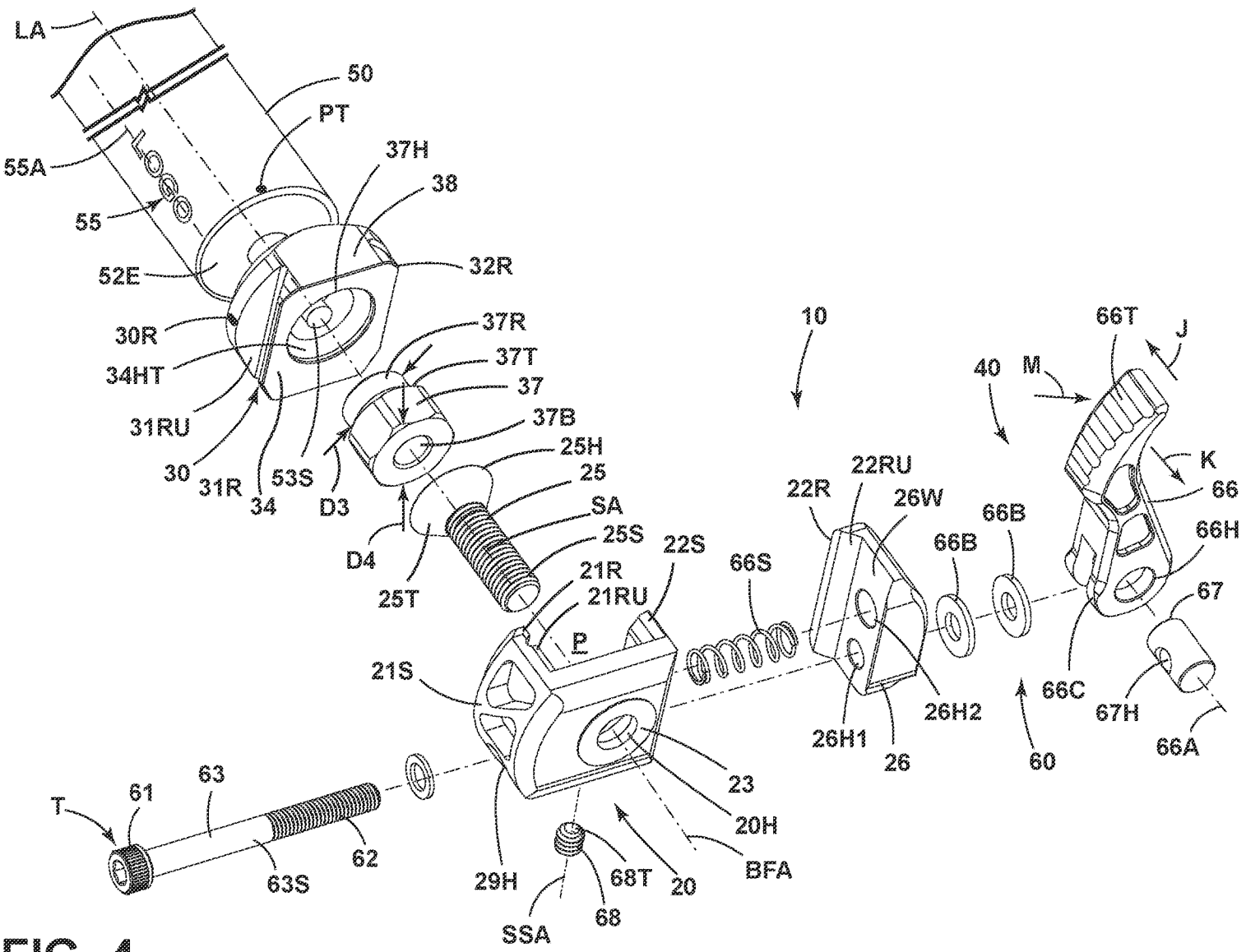
FIG. 4 is a rear exploded view of the archery stabilizer mount.
Figure 5:
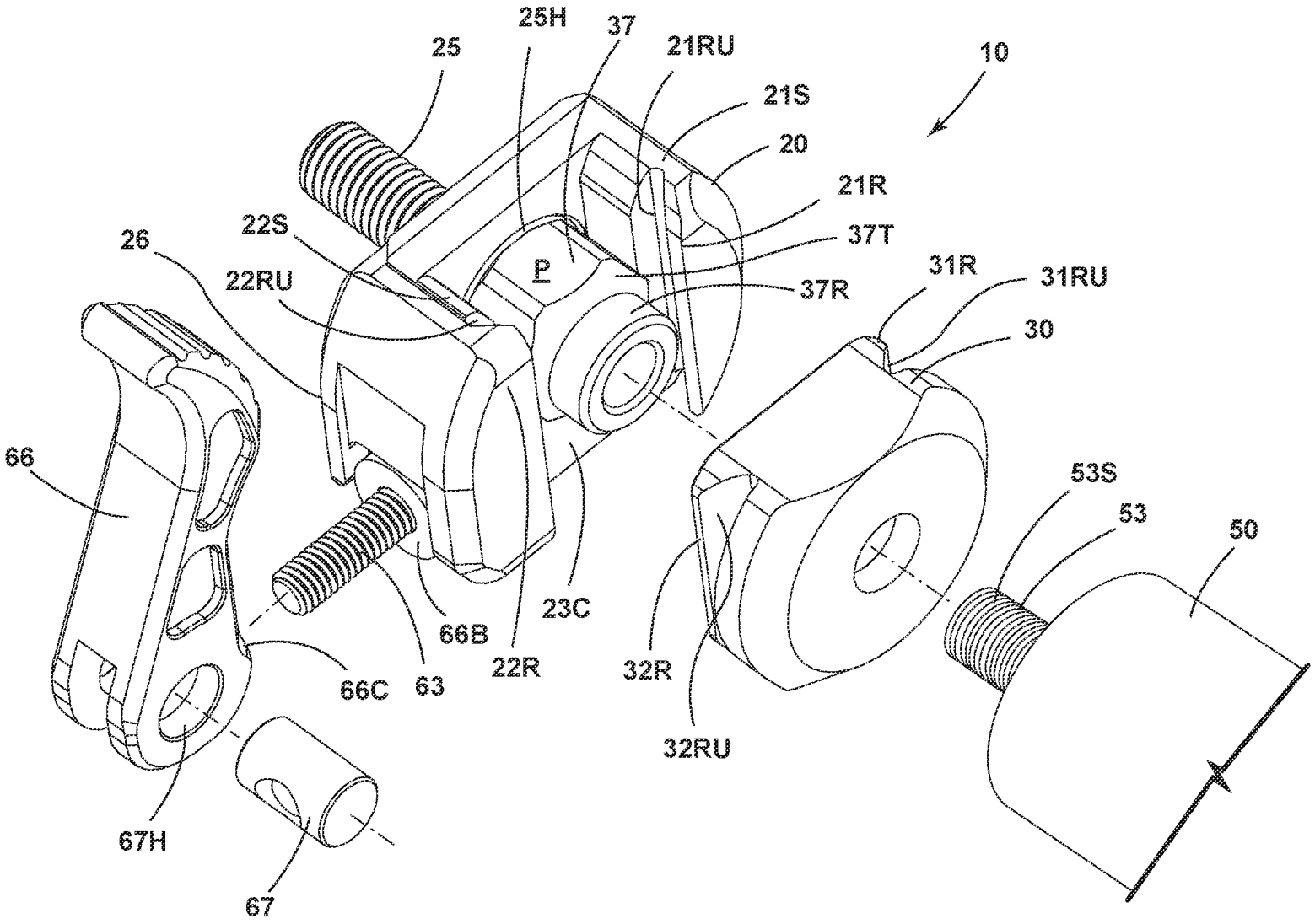
FIG. 5 is a front partially exploded view of the mount with a retaining element in a pocket of the bracket, concealing a riser fastener.

As shown in FIGS. 2-4, the bracket 20 can include a movable capture plate 26. The movable capture plate can include a wall 26W that faces toward the second wall 22S and its exterior. The capture plate 26 can include a second bracket rail 22R that also includes a second undercut 22RU. This second bracket rail 22R can interface with the second base rail 32R as described further below to secure the base 30 to the bracket 20. The movable capture plate 26 generally can be movable toward and away from the second side wall 22S and/or the first sidewall 21S, particularly if that second side wall 22S is absent, and can exert a force F in the direction of the arrows as shown in FIG. 3. This force F can be used to capture and clamp the base 30 relative to the bracket 20. In particular, the plate 26 can move toward the second base rail 32R when the first base rail 31R is placed adjacent the first bracket rail 21R or in the undercut 32RU. As a result, the second rail 22R engages, contacts and/or interfaces with the second base rail 32R and enters the second base undercut 32RU, effectively locking the base relative to the bracket. When the base is locked relative to the bracket, via the movement of the capture wall and its respective rail relative to the mount, or some other mechanism, the base is immovable and locked relative to the bracket and cannot move or be removed relative to the bracket.

To provide movement to the bracket capture wall, or any other mechanism that might be used to effectively clamp, hold or otherwise secure the first and second bracket rails relative to the first and second base rails, or vice versa, a lock 60 can be included. As shown, the lock 60 can interface with the capture plate 26, but just as likely could interface with some other component associated with one or more of the rails, to generally move one rail toward another rail, whether on the bracket or on the base. The lock 60 optionally can include a lock fastener 63 including a first end 61 and a second and 62. The second end 62 and shaft 63S can be inserted into the hole 29H. The lock fastener 63 can project through a fastener hole 29H defined by the bracket 20, optionally under, below or alongside the pocket P, optionally forward of the plate 23. This second end 62 can project through a first hole 26H1 defined by the capture plate 26 to further interface with a pivot nut 67. The pivot nut 67 can define a threaded bore 67H and the second end 62 of the lock fastener 63 can be threaded into the threaded bore 67H. The pivot nut 67 can be received in a set of holes 66H defined by a lever 66. The lever 66 can be rotatable about an axis 66A and generally about the pivot nut 67. The lever 66 can include a control surface 66T which can be engaged and operated manually by an operator. The lever 66 can further include a cam 66C that can interface with a side surface of the capture plate 26 to move the capture plate 26 and thus secure the base relative to the bracket via interfacing of the respective rails of each of the base and the bracket. In some cases, one or more bushings 66B can be disposed between the cam 66C and the sidewall of the capture plate 26. These bushings can be made from brass, polymers, composites or other materials to facilitate sliding movement of the cam relative thereto, and thus operation of the cam rotating about the axis 66A. The bushings also can operate as a wear surface for the cam.

As mentioned above, the lock can be operable 60 to contact, engage, position and/or clamp the first bracket rail relative to the first base rail and/or the second bracket rail relative to the second base rail, thereby securing the base 30 relative to the bracket 20 and thus to the riser when the bracket is secured to the riser with the bracket fastener 25. The lock can be operable in an unlocked mode to enable the base to be removed from the bracket, for example, as shown in FIG. 2, where the base carries the archery stabilizer so that the stabilizer itself can be completely removed from the bracket and from the riser.

The base rails and the bracket rails optionally can be configured with respective undercuts and rail parts as shown that can engage, contact, interface or clamp with one another. In some applications, the rails can be configured as picatinny rails and components that interface with one another to secure the base and bracket to one another. In other applications, the rails can be configured as weaver type or dovetail type rails and components that interface with one another to secure the base and bracket to one another. The respective rails can include corresponding wedge shapes and ramped surfaces so that when they engage one another, they exert corresponding locking forces relative to one another. It will be appreciated that either the base or the bracket can include the lock or capture plate, or some other mechanism to secure the rails, or more generally the base and the bracket to one another in a releasable and repeatably lockable manner.

Optionally, the lock 60 can include a secondary fastener 68 that can engage the lock fastener 68 along a portion of the shaft 63S of that lock fastener 63. As an example, the secondary fastener 68 can be in the form of a set screw including a tip 68T as shown in FIGS. 1 and 4. The set screw 68 can be disposed in a set screw hole 23SS as shown in FIG. 1. The set screw 68 can be tightened and can move along its axis SSA to engage the lock fastener 63 along the shaft 63S so that the lock fastener 63 is longitudinally and rotationally fixed and secured within the lock fastener hole 29H defined by the bracket 20. The lock fastener cannot move relative to that hole or to the bracket 20. The secondary fastener 68 can secure the lock fastener 63 in place so that a user can set a suitable amount of force F (FIG. 3) exerted by the bracket and the plate to secure the base and bracket together.

As an example, a user can tighten the lock fastener 63 in direction T which in turn engages the pivot nut 67. This can draw the pivot nut and the cam 66C closer to the wall, and change the amount of force M that is required to engage the lever 66 and move it in direction K to disengage the cam 66C sufficiently from the capture plate 26 and thereby release the rail 22R from the second base rail 32R. The user can calibrate and/or select a suitable amount of force for the movement K to disengage and reengage the rails and thus clamp the base 30 relative to the bracket 20. The user can adjust the amount of tightening T of the lock fastener 63 relative to the pivot nut 67 to provide a calibrated amount of force M that allows the lever 66 to be moved, yet adequately engage the cam 66C with the capture wall 26 to secure the base solidly relative to the bracket. The user optionally can engage the secondary faster 68 against the lock fastener 63 and secure that lock fastener 63 in a fixed position relative to the bracket. This in turn can prevent the lock fastener 63 from backing out or rotating in a direction opposite direction T and loosening from the pivot nut on the opposite side of the bracket. In turn, this can maintain the amount of force M sufficient to move the lever 66. As mentioned above, the secondary fastener 68 can be in the form of a set screw and can have an axis SSA that is transverse and optionally perpendicular or orthogonal to an axis of the lock fastener 63.

The base 30 as shown in FIGS. 1-4 can include one or more rails 31R and 32R. The rails can be separated by a gap sufficient to receive the rails of the bracket. The base can include a central portion 38 from which the respective first rail 31R and second rail 32R of the base project. These rails can project on opposite lateral and medial sides of the central portion 38. The base can include an upper surface 30U and an opposing lower surface 30L. The base can include a forward face 30F that engages or interfaces with the surface 52E of the stabilizer. The base also can define the stabilizer fastener hole 30H as described herein.

With reference to FIGS. 2-4, the base 30 can fit within the pocket P of the bracket 20, with the respective base rails interfacing with the respective bracket rails to secure or hold the components together when the lock 60 is operated to a locked mode. The base 30 as shown in FIG. 3 also can cover and conceal the fastener 25 when it is installed relative to the pocket. The retaining element 30 also can be disposed in the pocket P and can further conceal the head 25H of the bracket faster 25. Indeed, when the base 30 is installed relative to the bracket 20, the axes of the shaft 25S, retaining element 37 and the respective holes that receive each of these components in the respective base and bracket can be aligned and coincident or parallel with one another. Turning now to FIG. 4, the retaining element 37 optionally can be in the form of a nut having a hexagonal or other shape, and a tapered section 37T extending to an annular ring 37R that is of a lesser diameter than the upper portion of the nut 37. For example, the dimension of the ring D3 can be less than the dimension of the nut D4. Each of the tapered section and annular ring as well as the nut can define a threaded bore 37B that can threadably receive the shaft 53S of the archery stabilizer 50, and can be tightened relative thereto.

As shown further in FIG. 4, a rear surface 34 of the base 30 can define a retaining element recess 34H within which the annular ring 37R and optionally a portion of the tapered section 37T of the nut can fit. This retaining element recess 34H can be coextensive with the stabilizer faster hole 30H. The stabilizer faster whole 30H however can have a diameter D5 that is less than the diameter D3 of the ring or the corresponding diameter of the retaining element hole 34H defined on the opposite or rear side of the base 30. As mentioned above, the retaining element hole 34H can be correspondingly shaped to the retaining element 37 and in particular, the ring 37R and the tapered section 37. When the retaining nut 37 is tightened relative to the stud 53 of the stabilizer 50, the transition or tapered section 37T of the nut 37 can engage the tapered portion 34HT of the recess 34H and softly seat the nut within that recess while providing a tightening action on the stud. As the nut 37 is tightened along the shaft 53S of the stud 53, the base 30 is clamped between the nut, in particular the tapered section 37T and the rear surface 52E of the stabilizer 50. During this tightening, the stud is drawn farther through the stabilizer fastener hole 30 each until sufficiently tightened relative to the nut 37. Of course, as described above and below, during this tightening, a user can be sure to index the archery stabilizer 50, a point on the stabilizer, a reference element of the archery stabilizer 50, or any secondary stabilizer or component 50S, in a fixed angular orientation relative to the base 30. Further, this angular orientation can be the relative angle of the reference element or its axis 55A as that is disposed about the longitudinal axis LA and relative to some reference line 30R of the base 30.

The archery bow stabilizer 50 used in conjunction with the stabilizer mount 10 can come in a variety of configurations. As shown, it can be in the form of an elongated rod having a longitudinal axis LA. The stabilizer 50 can have an exterior surface 50E. This exterior surface 50E can include a reference element 55, which as mentioned above can be in the form of a branding element having a branding axis 55A. The branding axis 55 can be offset at distance D1 from the longitudinal axis LA. This distance D1 can correspond with an outwardly emanating ray extending from the longitudinal axis LA to the branding access 55A. This ray R1 can be clocked to, aligned with or point to a particular reference line 30R, which although shown on a side of the base 30 can be located at any location 360 degrees around the longitudinal axis. The precise clocking of the ray can correspond to alignment of the reference element in a particular orientation such that it can be easily read or perceived. Sometimes, the ray R1, when the base 30 is installed relative to the bracket 20, can be disposed in a horizontal plane HP as shown in FIG. 1 when the riser is vertically oriented.

Optionally, as mentioned above, the archery stabilizer can be of an elongated form. The stabilizer can be of various lengths, for example, 6 inches, 12 inches, 18 inches, 24 inches, etc. As also mentioned above, the stabilizer 50 can include a clamp 50C that secures to one or more secondary stabilizers 50S. These other stabilizer 50S can be of an elongated form as well, generally forming bars that can extend forward and/or rearward and/or laterally away from the primary stabilizer 50. One or more of the stabilizers 50 also can be outfitted to include one or more weights 50W1, 50W2 that are disposed at a distal end of the elongated stabilizer 50, distal from the base and bracket. These weights can come in varying dimensions and weights. Some of the weights can be at least 1 ounce, at least 2 ounces, at least 3 ounces, at least 4 ounces, at least 5 oz, at least 10 oz, at least 15 ounces or other weights, depending on the application. The weights also can be stacked relative to one another and held on the distal end of the stabilizer via a weight fastener 50WF shown in FIG. 2 that can be screwed into the distal end of the stabilizer holding the weights in place there. Other types of weight setups are contemplated, and in some cases, the weights can be absent from the stabilizer.

A method of using the archery stabilizer mount 10 of the current abandonment will now be described with reference to FIGS. 1-5. Generally, the method can include securing the bracket 20 to a riser 101 of the archery bow 100. To do so, the riser fastener 25 can be projected in the riser hole 101H defined by the riser 101. The elongated archery stabilizer 50 including a reference element 55 aligned with a longitudinal axis LA of the elongated archery stabilizer can be provided. The reference element 55 can be aligned in a preselected angular orientation relative to the base 20 as described above. The elongated archery stabilizer 50 can be secured to the base 30 in a fixed manner, with the reference element 55 being fixed in the preselected angular orientation relative to the base 30. The base 30 can be installed relative to the bracket 20. The lock 60 can be operated to clamp, lock or secure the base 30 in a fixed position relative to the bracket 20 and thus the riser 101. Optionally, even after clamping the base relative to the bracket, the reference element 55 can remain in the preselected angular orientation relative to the base and thus the riser during any subsequent removal and/or reinstallation of the elongated archery stabilizer 50 relative to the riser 101.

More particularly, the archery stabilizer 50 can be secured to the base 30 and calibrated so that the reference element 55, for example a logo having a branding axis 55A is aligned with a reference line 30R. A stud 53 or other shaft of the stabilizer can be placed through the stabilizer faster hole 30H and can project into the retaining element recess 34H. The retaining element 37 can be threaded onto the stud. As the retaining element 37 is turned onto the stud, the annular ring 37R enters the recess and the tapered section 37T can engage the corresponding recess tapered portion 34HT until the base 30 is sufficiently clamped between the nut 37 and the stabilizer 50. The user can align the axis 55A as best they can with the reference line 30R or generally estimate a position such that the reference element will be at a predetermined angular orientation relative to the base for installation on the bracket, and thus the bow, to provide a desired aesthetic and/or visual effect of the stabilizer, and any suitable weight distribution of any secondary stabilizer 50S or other component.

The user can move the base 30 in direction G as shown in FIG. 2 such that the base at least partially enters the pocket P defined by the bracket 20. In so doing, the first and second base rails 21R and 22R can move relative to, slide along and/or engage the first and second bracket rails 31R and 32R respectively as the base enters the pocket P. The base can be moved further in direction G, moving vertically downward along the forward portion of the riser 101. During this movement, the central portion 38 of the base 30 can enter, move within and/or slide relative to the pocket and the respective sidewalls 21S, 22S of the plate 23 of the bracket 20. Likewise, the retaining element also can enter, move within, slide relative to these respective components. When the retaining element 37 engages the floor or wall 23C, which optionally can be a curved cup or portion of the bracket, downward movement of the base and stabilizer can be arrested relative to the bracket 20. The base also can be at least temporarily trapped, but not fully locked within the confines of the pocket, in particular within the rails of the base and bracket interfacing with one another and the retaining element 37 being trapped within the pocket between the respective side walls 21S, 22S and the floor 23C of the pocket P.

When in this position, the riser fastener 25 can be covered or concealed with the base and or retaining element 37, optionally before the base is locked relative to the bracket. This riser fastener can be the sole or single element securing the bracket to the riser. With the base mounted relative to the bracket in a suitable manner, the user can actuate the lock 60. Generally, the lock can be operated to clamp or secure the base in a fixed position relative to the bracket and the riser 101. More specifically, the lever 66 can be operated and rotated about the pivot axis 66A in direction J, for example, shown in FIGS. 3 and 4. Before placement of the base 30 relative to the bracket, this lever 66 can be in the configuration shown in FIG. 2, such that sliding movement between the respective rails can be achieved. As shown in FIG. 4, with the lever 66 moved in direction J, the cam 66C can engage the capture plate 26, and any bushings 66B that may be disposed between that plate for wear. Optionally, the lever 66 also can compress a spring 66S that can assist in opening the lever in direction K when the base is being removed from the bracket.

When the lever is moved and the cam 66C engages the capture plate 26, the capture plate moves in the direction of the arrows and exerts a force F as shown in FIG. 3. This force F is translated from the second bracket rail 22R to the second base rail 32R. Simultaneously, the first base rail 31R also can interface with the first bracket rail 21R upon this clamping action. As a result, the rails interface with and engage one another, forcibly wedging against one another and thereby securing the base to the bracket. After the lever 66 is sufficiently moved to engage the cam 66C with the capture plate 26 and thereby engage the respective rails with one another, the base 30 is fixedly secured relative to the bracket. In turn, the base is secured to the bracket which is further secured to the riser as described above. As a result, the riser 50 and its elongated longitudinal axis LA projects forwardly from the riser 101 as shown in FIGS. 1 and 3. Even after this installation, due to the precise calibration and location of the reference element 55 at the predetermined angular orientation relative to the base 30, that predetermined angular orientation is maintained. Accordingly, the reference axis 55A is disposed at a particular orientation, for example, in a horizontal orientation within a horizontal plane HP when the riser is disposed in a vertical plane VP as shown in FIG. 1. Again other angular orientations can be selected depending on the application.

With the current embodiment of the archery riser mount 10, after the archery stabilizer and bow are used, the stabilizer and mount can be quickly detached from the bracket. To do so, the user can move the lever 66 in direction K shown in FIG. 4. As a result, the lever transitions to the configuration shown in FIG. 2. A user can vertically remove the base 30 from the pocket P of the bracket 20. As this occurs, the rails can move and/or slide along their length relative to one another. The user can then transport the archery bow with only the bracket 20 attached to it, and the stabilizer 50 and mount 30 removed and separate from that bracket 20 and bow 100. The bracket can be stored and/or transported with the archery bow. When the user desires to reinstall the stabilizer 50, the user only need insert the base 30 into the pocket P of the bracket 20 again and operate the lever accordingly to lock the base in a fixed orientation relative to the bracket. Due to the prior calibration of the archery stabilizer and any reference element in a predetermined preselected angular orientation, and the fixing of the archery stabilizer 50 relative to the base 30 via the retaining element 37 in that fixed angular orientation, the user need not repeat that calibration again, and can simply install the base relative to the bracket. Upon doing so, the user can be confident that archery stabilizer 50, and the reference element 55 and any associated axis 55A is in the predetermined angular orientation without fail. This provides consistent removal and installation and reinstallation of the archery stabilizer with the mount 10, without altering the orientation of the reference element 55 and or its axis 55A upon the same. The user only once calibrates and sets the precise position of the reference element 55 and axis 55A relative to the mount and bracket, and does not worry about it again.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention bracketed on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A method of installing a stabilizer on an archery bow, the method comprising:

installing a fastener relative to a bracket such that the fastener extends through the bracket and into a riser hole defined by a riser of an archery bow;

engaging a fastener head against the bracket to secure the bracket to the riser, the bracket including a bracket pocket bounded by a first bracket rail and a moveable capture plate including an opposing second bracket rail;

providing an elongated stabilizer including a reference element aligned with a longitudinal axis of the elongated stabilizer;

aligning the reference element in a preselected angular orientation relative to a base including a central portion bounded by a first base rail and an opposing second base rail, where a shaft of the stabilizer projects at least partially through a stabilizer fastener hole of the base;

engaging a fastener to the shaft to secure the elongated stabilizer to the base, with the reference element being fixed in the preselected angular orientation relative to the base;

interfacing the first bracket rail with the first base rail, and the second bracket rail with the second base rail so that the base registers with the bracket, the base covering the fastener head; and operating a lock to move the second bracket rail to clamp the base within the bracket in a fixed position, whereby the elongated stabilizer is secured to and projects forwardly of the base, bracket and riser of the archery bow.

2. The method of claim 1 comprising:

sliding the central portion in the bracket pocket, wherein the first base rail and the second base rail are disposed between the first bracket rail and the second bracket rail.

3. The method of claim 1, comprising:

moving a lever joined with a lock fastener of the lock; and engaging a cam against at least one of the first and second bracket rails to urge the at least one of the first and second base rails into engagement with the base.

4. The method of claim 3, wherein the first and second base rails engage the first and second bracket rails, respectively, to clamp the bracket relative to the base and secure the base in a fixed position relative to the riser.

5. The method of claim 1, wherein the reference element is a branding element having a branding axis, wherein the preselected angular orientation coincides with the branding axis and the longitudinal axis laying in a horizontal plane when the archery bow is drawn by a user.

6. The method of claim 5, wherein the branding element includes a plurality of alphanumeric characters extending along the branding axis.

7. A method of installing a stabilizer on an archery bow, the method comprising:

installing a fastener relative to a bracket such that the fastener extends through the bracket and into a riser hole defined by a riser of an archery bow;

engaging a fastener head against the bracket to secure the bracket to the riser, the bracket including a bracket pocket bounded by a first bracket rail and an opposing second bracket rail;

providing an elongated stabilizer including a reference element aligned with a longitudinal axis of the elongated stabilizer;

aligning the reference element in a preselected angular orientation relative to a base including a central portion bounded by a first base rail and an opposing second base rail, where a shaft projects at least partially through the base;

engaging the shaft to secure the elongated stabilizer to the base, with the reference element being fixed in the preselected angular orientation relative to the base;

interfacing the first bracket rail with the first base rail, and the second bracket rail with the second base rail so that the base registers with the bracket, the base covering the fastener head; and operating a lock to clamp the base within the bracket in a fixed position, whereby the elongated stabilizer is secured to and projects forwardly of the base, bracket and riser of the archery bow, wherein the engaging the shaft includes threading a nut relative to the shaft so that the nut clamps the base between the nut and the elongated stabilizer.

8. A method of installing a stabilizer on an archery bow, the method comprising:

installing a fastener relative to a bracket such that the fastener extends through the bracket and into a riser hole defined by a riser of an archery bow;

engaging a fastener head against the bracket to secure the bracket to the riser, the bracket including a bracket pocket bounded by a first bracket rail and an opposing second bracket rail;

providing an elongated stabilizer including a reference element aligned with a longitudinal axis of the elongated stabilizer;

aligning the reference element in a preselected angular orientation relative to a base including a central portion bounded by a first base rail and an opposing second base rail, where a shaft projects at least partially through the base;

engaging the shaft to secure the elongated stabilizer to the base, with the reference element being fixed in the preselected angular orientation relative to the base;

interfacing the first bracket rail with the first base rail, and the second bracket rail with the second base rail so that the base registers with the bracket, the base covering the fastener head; and operating a lock to clamp the base within the bracket in a fixed position, whereby the elongated stabilizer is secured to and projects forwardly of the base, bracket and riser of the archery bow, wherein the bracket defines a head recess, wherein the fastener head is disposed in the head recess, wherein the base defines a nut recess, wherein the engaging incudes tightening a nut relative to the shaft so that the nut is disposed in the nut recess.

9. A method of installing a stabilizer on an archery bow, the method comprising:

installing a fastener relative to a bracket such that the fastener extends through the bracket and into a riser hole defined by a riser of an archery bow;

engaging a fastener head against the bracket to secure the bracket to the riser, the bracket including a bracket pocket bounded by a first bracket rail and an opposing second bracket rail;

providing an elongated stabilizer including a reference element aligned with a longitudinal axis of the elongated stabilizer;

aligning the reference element in a preselected angular orientation relative to a base including a central portion bounded by a first base rail and an opposing second base rail, where a shaft projects at least partially through the base;

engaging the shaft to secure the elongated stabilizer to the base, with the reference element being fixed in the preselected angular orientation relative to the base;

interfacing the first bracket rail with the first base rail, and the second bracket rail with the second base rail so that the base registers with the bracket, the base covering the fastener head; and operating a lock to clamp the base within the bracket in a fixed position, whereby the elongated stabilizer is secured to and projects forwardly of the base, bracket and riser of the archery bow, wherein the operating the lock includes urging the first bracket rail against the first base rail with a cam lever rotating relative to a lock fastener, engaging a set screw against the lock fastener to impair the lock fastener from rotating relative to the bracket.

10. A method of installing an archery stabilizer on an archery bow, the method comprising:

securing a bracket to a riser of an archery bow with a fastener projecting in a riser hole defined by the riser, the bracket including a first bracket rail and an opposing second bracket rail;

providing an elongated archery stabilizer including a reference element aligned with a longitudinal axis of the elongated archery stabilizer;

aligning the reference element in a preselected angular orientation relative to a base including a first base rail and an opposing second base rail;

securing the elongated archery stabilizer to the base in a fixed manner, with the reference element being fixed in the preselected angular orientation relative to the base;

interfacing the first bracket rail with the first base rail, and the second bracket rail with the second base rail so that the base registers with the bracket in a fixed angular orientation; and operating a lock without rotating the elongated archery stabilizer and reference element about the longitudinal axis, to clamp the base in a fixed position relative to the bracket and the riser, whereby the reference element remains in the preselected angular orientation relative to the base to thereby function as an indicator of alignment of the base and the bracket while the base is registered with the bracket and the bracket is secured to the riser, and thus the riser during a subsequent removal and re-installation of the elongated archery stabilizer relative to the riser by aligning the first and second base rails with the first and second bracket rails.

11. The method of claim 10, wherein the reference element is a branding element having a branding axis, wherein the preselected angular orientation coincides with the branding axis and the longitudinal axis laying in a horizontal plane when the archery bow is drawn by a user.

12. The method of claim 11, wherein the branding element includes a plurality of alphanumeric characters extending along the branding axis.

13. The stabilizer mount of claim 10, wherein the reference element is a branding element having a branding axis, wherein the preselected angular orientation coincides with the branding axis and the longitudinal axis aligned with a horizontal plane when the archery bow is drawn by a user.

14. A method of installing an archery stabilizer on an archery bow, the method comprising:

securing a bracket to a riser of an archery bow with a fastener projecting in a riser hole defined by the riser, the bracket including a first bracket rail and an opposing second bracket rail;

providing an elongated archery stabilizer including a reference element aligned with a longitudinal axis of the elongated archery stabilizer;

aligning the reference element in a preselected angular orientation relative to a base including a first base rail and an opposing second base rail;

securing the elongated archery stabilizer to the base in a fixed manner, with the reference element being fixed in the preselected angular orientation relative to the base;

interfacing the first bracket rail with the first base rail, and the second bracket rail with the second base rail so that the base registers with the bracket; and operating a lock to clamp the base in a fixed position relative to the bracket and the riser, whereby the reference element remains in the preselected angular orientation relative to the base and thus the riser during a subsequent removal and re-installation of the elongated archery stabilizer relative to the riser by aligning the first and second base rails with the first and second bracket rails, covering the fastener with the base as the base registers with the bracket, wherein the lock is joined with the bracket, wherein the lock includes lever joined with a cam, and the lever is rotatable relative to a lock fastener, wherein the fastener projects through the bracket, securing the lock fastener in a fixed position relative to the bracket by tightening a fastener to engage a shaft of the lock fastener distal from the lever.

15. A stabilizer mount for an archery bow, the stabilizer mount comprising:

a bracket including a first bracket rail and a second bracket rail included on a moveable capture plate, the bracket defining a bracket fastener hole having a bracket fastener hole axis;

a bracket fastener projecting though the bracket fastener hole and configured to secure the bracket to an archery bow riser;

a base including a first base rail and a second base rail, the base defining a stabilizer fastener hole having a stabilizer fastener hole axis aligned with the bracket fastener hole axis, the first base rail interfacing with the first bracket rail, the second base rail interfacing with the second bracket rail; and a retaining element, configured to engage an elongated archery stabilizer to secure the archery stabilizer in a fixed, angular orientation relative to the base, the retaining element disposed between the bracket and the base a lock operable in a lock mode to move the second bracket rail to clamp the first bracket rail relative to the first base rail and the second bracket rail relative to the second base rail, thereby securing the base relative to the bracket, the lock operable in an unlocked mode to enable the base to be removed from the bracket, along with the archery stabilizer, whereby the base can be repeatedly removed from and installed relative to the bracket while maintaining the archery stabilizer in the fixed angular orientation relative to the base and to the bracket.

16. The stabilizer mount of claim 15, wherein the stabilizer fastener hole axis is parallel to the bracket fastener hole axis when the base is installed relative to the bracket, wherein the elongated archery stabilizer includes a longitudinal axis, wherein the stabilizer hole axis is parallel to the longitudinal axis when the base is installed relative to the bracket.

17. The stabilizer mount of claim 15, wherein the lock includes a lock fastener, wherein a secondary fastener disposed transverse to the lock fastener engages the lock fastener to secure the lock fastener in a fixed position, whereby the lock operates in the lock mode to apply a consistent clamping force due to the lock fastener being in the fixed position.

18. A stabilizer mount for an archery bow, the stabilizer mount comprising:

a bracket including a first bracket rail and a second bracket rail, the bracket defining a bracket fastener hole having a bracket fastener hole axis;

a bracket fastener projecting though the bracket fastener hole and configured to secure the bracket to an archery bow riser;

a base including a first base rail and a second base rail, the base defining a stabilizer fastener hole having a stabilizer fastener hole axis aligned with the bracket fastener hole axis, the first base rail interfacing with the first bracket rail, the second base rail interfacing with the second bracket rail; and a retaining element disposed between the bracket and the base, and configured to engage an elongated archery stabilizer to secure the archery stabilizer in a fixed, angular orientation relative to the base;

a lock operable in a lock mode to clamp the first bracket rail relative to the first base rail and the second bracket rail relative to the second base rail, thereby securing the base relative to the bracket, the lock operable in an unlocked mode to enable the base to be removed from the bracket, along with the archery stabilizer, whereby the base can be repeatedly removed from and installed relative to the bracket while maintaining the archery stabilizer in the fixed angular orientation relative to the base and to the bracket, wherein the bracket fastener and bracket fastener hole are covered by the base when the base is installed relative to the bracket, wherein the base includes a retaining nut configured for securement to the archery stabilizer, wherein the retaining nut is disposed in a pocket defined by the bracket when the base is installed relative to the bracket.

* * * * *